US006034006A

United States Patent [19]

Arpin et al.

[11] Patent Number: 6,034,006

[45] Date of Patent: Mar. 7, 2000

[54] PROCESS FOR MANUFACTURING A GLASS MAT AND PRODUCT RESULTING THEREFROM

[75] Inventors: Michel Arpin; Fabrice Duchamp, both of La Motte-Servolex; Michel Mottet, Aze, all of France

[73] Assignee: Vetrotex France S.A., Chambery, France

[21] Appl. No.: 08/875,924

[22] PCT Filed: Dec. 12, 1996

[86] PCT No.: PCT/FR96/01988

§ 371 Date: Dec. 29, 1997

§ 102(e) Date: Dec. 29, 1997

[87] PCT Pub. No.: WO97/21861

PCT Pub. Date: Jun. 19, 1997

[30] Foreign Application Priority Data

Dec. 12, 1995 [FR] France ..... 95 15113

[51] Int. Cl.[7] ..... B32B 27/30

[52] U.S. Cl. ..... 442/173; 442/180; 427/365; 427/366; 427/389.8; 427/420; 427/424

[58] Field of Search ..... 427/365, 366, 427/389.8, 420, 424; 442/173, 180

[56] References Cited

U.S. PATENT DOCUMENTS

| | | | |
|---|---|---|---|
| 3,622,445 | 11/1971 | Heidweiller | 162/145 |
| 3,630,831 | 12/1971 | Jongetjes | 162/156 |
| 4,734,321 | 3/1988 | Radvan et al. | 428/283 |

FOREIGN PATENT DOCUMENTS

| | | | |
|---|---|---|---|
| 2113905 | 6/1972 | France | D04H 1/00 |

*Primary Examiner*—Christopher Raimund

*Attorney, Agent, or Firm*—Oblon, Spivak, McClelland, Maier & Neustadt, P.C.

[57] ABSTRACT

The subject of the invention is a process for manufacturing a glass strand mat, in which a binder is deposited continuously on a wad of glass strands. The strands are distributed on a moving conveyor, and then the wad is subjected to an oven treatment and possibly to calendering. The process consists of depositing on the wad of strands a liquid binder whose viscosity during deposition is less than approximately 40 millipascal seconds, the binder being formed by an aqueous solution of polyvinyl alcohol(s).

10 Claims, No Drawings

PROCESS FOR MANUFACTURING A GLASS MAT AND PRODUCT RESULTING THEREFROM

BACKGROUND OF THE INVENTION

1. Field of the Invention

The present invention relates to a process for manufacturing a mat consisting of glass strands and the product which results therefrom. By glass mat is meant a product formed by glass strands (these being chopped or continuous strands), the constituent filaments of which remain bonded together, thus being distinguished from glass veil formed by the combining of dispersed glass filaments.

2. Description of the Background

When manufacturing a glass strand mat, among the main problems to be solved are the choice of the nature of the binder which will give cohesion to the mat, the form in which the binder will be used and the process which will ensure contact of the binder with the mat.

There are many solutions to these problems.

Thus, the nature of the binder chosen is usually dependent on its chemical compatibility with the resin system which the mat is to reinforce.

The binder may be used equally well in powder, suspension, emulsion or solution form. When the binder is used in a form other than a dry powder, the liquid with which it is combined is more and more often water so as to avoid the difficulties which the use of organic solvents always presents.

The methods of application are also very varied.

Although deposition of the binder in the form of a dry powder avoids the use of a liquid, which it will be necessary subsequently to remove, it is difficult to distribute it uniformly within the mass of the mat. Moreover, the binder grains sometimes remain in the composite reinforced by the mat, giving it an uneven surface finish.

The deposition of a binder in the form of an emulsion or of a solution in water or in an organic solvent gives the mat good cohesion since, usually, it adheres albeit partly to the glass strands. However, this advantage may prove to be less beneficial when the mat has to be combined with a product which it must reinforce, whether this is organic or inorganic. This is because, when the binder remains on the glass strands during this combining phase, it may constitute an obstacle to good wetting of the said strands by the said product. This is especially the case when the mat is to be combined with a resin which is in the form of a dispersion or suspension in water or with a mixture based on cement and water. This results in a decrease in the mechanical properties and in a poor surface finish of the final composite component.

SUMMARY OF THE INVENTION

The subject of the present invention is a manufacturing process which makes it possible to obtain a glass strand mat which exhibits good cohesion and which is easily wetted by the resins, especially by the resins in aqueous medium, especially in aqueous solution, dispersion or suspension, or by a mixture based on cement and water.

The subject of the present invention is a manufacturing process which enables the binder to be uniformly distributed throughout the thickness of the mat.

The subject of the present invention is also a process for manufacturing a glass strand mat which allows continuous recycling of the binder used.

These objectives are achieved using a manufacturing process which consists in continuously depositing on a sheet of glass strands, distributed on a moving conveyor, a binder whose viscosity during deposition is less than approximately 40 millipascal seconds, the said binder being formed by an aqueous solution of polyvinyl alcohol(s).

DETAILED DESCRIPTION OF THE INVENTION

The polyvinyl alcohol or alcohols employed within the context of the invention preferably have a degree of polymerization of less than approximately 1,000.

The binder is deposited on the sheet of glass strands in the form of a liquid sheet or of a wall of liquid streams which fall transversely over the entire width of the said sheet of strands. The binder thus deposited, by virtue of its relatively low viscosity, penetrates and passes right through the sheet of strands, becoming distributed throughout the volume of the said sheet. The binder is retained essentially on most of the points of contact of the intersecting strands. The binder is deposited while its temperature is greater than approximately 10° C. and most generally between 20 and 60° C.

The flow rate of binder thus deposited depends especially on the speed of the conveyor and on the quantity of glass deposited per square metre on the said conveyor. This binder flow rate is determined so as to obtain between approximately 3 and 15% by weight of binder in the dry-matter state with respect to the weight of glass.

In a variant, the binder may be partly deposited on the surface of the sheet of strands, upstream of the region in which it is deposited in the form of liquid streams or of a liquid sheet. The binder may, for example, be sprayed upstream, this having the effect of lightly compressing the sheet of strands and of moistening its surface layer, thus promoting penetration of the binder deposited downstream.

A fraction of the binder thus deposited passes completely through the sheet of strands and may be recovered beneath the conveyor. One of the advantages of the binder used is that it is stable over time, even after having been heated to a temperature greater than approximately 30° C., contrary to the binders whose composition contains at least one constituent which promotes its crosslinking. The binder used within the context of the invention may thus be immediately recycled, this constituting an economic advantage.

Once the binder has been deposited, the sheet of strands passes through an oven in a manner known per se, and then possibly into a calender.

The process according to the invention applies to glass strand mats obtained by any known means, whether these involve continuous or batch processes.

The first type of process is used to manufacture mats of continuous glass strands. It most often consists in drawing a multiplicity of filaments from molten glass flowing out of the orifices of several spinnerets, in bringing these filaments together in an amount of at least one strand per spinneret and in mechanically distributing the strands thus obtained on a conveyor moving beneath the said spinnerets.

The second type of process is generally used to manufacture mats of chopped glass strands. It consists in extracting continuous strands from a multiplicity of wound packages, in chopping them simultaneously and in distributing them on a moving conveyor.

The second type of process may be used to manufacture mats of continuous strands when extraction of the strands from their wound package is immediately followed by their distribution on the conveyor.

For some applications, the mat employed may be reinforced with continuous glass strands arranged longitudinally over at least part of its width. This is the case especially when the mat is intended to be combined with a cement-based mixture.

This mat is obtained, for example, by simultaneously distributing the chopped strands and the continuous strands on the moving conveyor, the latter being extracted from a series of wound packages.

Whatever the process used, the average diameter of the filaments making up the strands is between approximately 9 and 30 micrometers. When chopped strands are used, the length of the said strands is generally greater than 20 millimeters.

One of the advantages of this mat is that the binder, brought into contact with a resin in aqueous medium, disappears almost entirely, thereby promoting wetting of the glass by the resin.

The advantages presented by the invention will be more clearly perceived through the detailed description hereinbelow of an entirely non-limiting embodiment example of the said invention.

A sheet of chopped strands 50 millimeters in length is deposited at a total glass output of 250 kilogrammes per hour onto a conveyor moving at a speed of 13 meters per minute. This sheet is obtained by simultaneously chopping a multiplicity of strands extracted from a multiplicity of wound packages. These glass strands, having a linear density of 30 tex, consist of a multiplicity of filaments having an average diameter of 12 micrometers; they have been coated, during their manufacture, with a conventional size based on polyvinyl acetate and on coupling agents such as silanes.

An aqueous solution of polyvinyl alcohol with a concentration of 8%, maintained at 30° C., whose viscosity at this temperature is 15 millipascal seconds, is deposited over the entire width of the sheet of strands in the form of a wall of liquid streams. This solution has been obtained by dissolving in water heated to 80° C. a polyvinyl alcohol characterized by a degree of polymerization of 530 and a degree of hydrolysis of 88%. This polyvinyl alcohol is marketed under the reference F 105 by the company LAMBERTI. This solution is poured onto the sheet of strands at an hourly flow rate of 3 cubic meters. The excess solution is sucked up under the conveyor and recycled.

Next, the sheet of strands thus treated passes into a hot-air oven inside which it is subjected to a temperature of the order of 200° C. for approximately 50 seconds. On leaving the oven, the sheet of strands is calendered and cooled before being wound up on a rotating mandrel.

The mat obtained has a binder content of 8% and has a surface density of 250 grammes per square metre. Its cohesion is good, as shown by its tensile strength which, measured according to the ISO 3342 method, is on average 40 decanewtons. By comparison, a mat which has the same characteristics, but whose binder content is 4.5%, this binder being plasticized polyvinyl acetate, has a tensile strength, measured using the same method, of less than 20 decanewtons.

The binder used in the present invention also has the advantage of being partially dissolved in the presence of water. The following test enables this to be demonstrated: a series of 100×125 millimeter specimens are cut from the mat whose manufacturing process was described above. These specimens are immersed in water at 20° C. and subjected to a load of 100 grammes. The partial removal of the binder into the water and the effect of the load cause the mat to tear into two parts after an average time of 25 seconds. This time is very short for this kind of test. Indeed, tearing of the mat bound with plasticized polyvinyl acetate, mentioned previously, occurs under the same conditions only after an average time in excess of 5 minutes.

This rapid removal of the binder enables the mat obtained according to the invention to be very readily combined with all kinds of products mixed with water, whether these be a cement mixture or a mixture of resins in the form of a dispersion or suspension in aqueous medium, and makes it possible to mould composite components whose mechanical properties and surface finish are particularly satisfactory. This is demonstrated by the comparative example described hereinbelow.

Cement plaques are produced by employing, on the one hand, a mixture based on cement and chopped glass strands, this being called a premix, and, on the other hand, a mat according to the invention or, by way of comparison, a known mat.

The mixture itself is conventional and its composition is as follows:

| | |
|---|---|
| ☐ artificial Portland cement, CEMI | 100 parts by weight |
| ☐ siliceous sand | 100 parts by weight |
| ☐ water | 40 parts by weight |
| ☐ thinning agent | 1.8 parts by weight |

Incorporated into this mixture in a manner known per se are 4.8 parts by weight of chopped glass strands having an average length of 12 millimeters.

The mat according to the invention has a surface density of 120 grammes per square metre and consists of chopped strands 50 millimeters in length, these strands having a linear density of 38 tex and consisting of a multiplicity of filaments having an average diameter of 14 micrometers. Its binder content is 10%.

The mat used by way of comparison has the same characteristics apart from the binder content, which is 4.5%, and the binder itself, which is plasticized polyvinyl acetate.

The glass used to obtained these mats is an alkali-resistant glass marketed under the brand name CEMFIL.

A first ply of mat is deposited in the bottom of a mould and covered with a ply of premix which is uniformly distributed by vibrating the said mould.

A second ply of mat, identical to the first, is deposited on the premix and then pressed against the premix by means of a roller so as to impregnate it. The plaque thus obtained is kept in the mould for 24 hours and then stored in a chamber maintained at 20° C. in an atmosphere having a relative humidity of 50%.

Specimens are removed from the plaques thus obtained and some of their mechanical properties in flexure are measured after 7 days and 28 days storage. The results of these measurements, carried out according to the pr.EN 1170-5 standard draft of March 1995, are collated in the following table.

| | % of fibre in the composite | MOR (7) | (MPa) (28) | YS (7) | (MPa) (28) | SAB (7) | (%) (28) |
|---|---|---|---|---|---|---|---|
| Premix + mat according to the invention | 3.4 | 16.1 | 15.7 | 8.5 | 9 | 0.76 | 0.72 |
| Premix + known mat | 3.4 | 13.5 | 15.1 | 8.3 | 10.2 | 0.55 | 0.54 |

The symbols MOR, YS and SAB denote, respectively, the modulus of rupture, the yield stress or limit of proportionality and the strain at break in the bending test.

The percentage of reinforcement in the premix is 2% by weight with respect to the composite for both kinds of plaques, the percentage of reinforcement due to the mat itself being 1.4% for the plaque reinforced with the mat according to the invention and for the plaque reinforced with the known mat.

These results show that the mat according to the invention confers excellent mechanical properties on the composite, especially a remarkable strain at break in view of the relatively low degree of reinforcement.

The examples illustrating the invention are not limiting and the combination of the mat according to the invention with a cement-based mixture may be produced in may ways, for example by being deposited in situ on all or part of a slab or fixed to a wall and covered by spraying with a layer of cement.

It is also possible to combine it with resins in aqueous medium by any means known to the person skilled in the art.

We claim:

1. A process for manufacturing a glass strand mat, comprising:

depositing a sheet of glass strands on a moving conveyor, applying a liquid binder composition containing an aqueous solution of polyvinyl alcohol, said liquid having a viscosity during deposition of less than approximately 40 millipascal seconds and in an amount so as to obtain between 3 and 15% by weight of binder in the dry-matter state with respect to the weight of glass, subjecting the sheet to an oven treatment and, optionally, calendaring, wherein the binder is deposited in the form of a liquid sheet or of a wall of liquid streams which fall onto the entire width of the sheet of strands, and wherein some of the binder is deposited upstream of the region in which it is deposited in the form of a liquid sheet or of a wall of liquid streams.

2. Process according to claim 1, wherein the binder is deposited upstream by spraying.

3. Process according to claim 1, wherein the fraction of binder which has passed through the sheet of strands is recovered from under the conveyor and immediately recycled.

4. Sheet of glass strands, obtained according to the process defined by claim 1, wherein its binder content is between approximately 3 and 15% by weight with respect to the weight of glass.

5. Glass strands mat obtained after oven treatment and possibly calendering of a sheet of glass strands according to claim 4, which is formed by strands consisting of glass filaments whose average diameter is between 9 and 30 micrometers.

6. Glass strands mat according to claim 5, which is formed by chopped strands whose length is greater than approximately 20 millimeters.

7. Glass strand mat according to claim 6, which is reinforces with continuous glass strands arranged longitudinally over at least part of the width of the said mat.

8. Glass mat according to claim 5, which is formed by continuous strands.

9. A composition, comprising cement, water and the glass strand mat according to claim 5.

10. A composition, comprising water, a resin and the glass strand mat according to claim 5.

* * * * *